United States Patent [19]

Massey

[11] 4,213,546

[45] Jul. 22, 1980

[54] CAP FOR THE NOZZLE OF A CAULKING CARTRIDGE

[76] Inventor: Richard C. Massey, 12301 Ballas La., St. Louis, Mo. 63131

[21] Appl. No.: 944,184

[22] Filed: Sep. 20, 1978

[51] Int. Cl.[2] ..... B65D 47/04

[52] U.S. Cl. ..... 222/546; 222/326; 220/379

[58] Field of Search ..... 222/325-327, 222/180, 546, 562; 220/379, 85 CH; 24/129 D, 130

[56] References Cited

U.S. PATENT DOCUMENTS

| | | | |
|---|---|---|---|
| Re. 18,526 | 7/1932 | Morrow . | |
| 2,650,448 | 9/1953 | Lichtig | 24/129 D |
| 2,731,053 | 1/1956 | Lockhart | 222/546 X |
| 2,754,033 | 7/1956 | Eiter | 222/326 |
| 2,831,615 | 4/1958 | Sherbondy | 222/326 X |
| 2,849,739 | 9/1953 | Dresden . | |
| 3,651,980 | 3/1972 | Bly | 220/379 |
| 3,930,599 | 1/1976 | Brothers et al. | 222/546 X |

*Primary Examiner*—Charles A. Marmor

*Attorney, Agent, or Firm*—Senniger, Powers, Leavitt and Roedel

[57] ABSTRACT

A cap to be placed on the nozzle of a caulking cartridge, for example, loaded in a caulking gun for preventing discharge from the nozzle and sealing it. The cap comprises an elongate hollow body closed at its front end and open at its back end for placement of the cap on the nozzle with the nozzle received inside the body. An elongate plug extending rearwardly within the body from the front end thereof enters the nozzle on placement of the cap on the nozzle for plugging the nozzle and preventing discharge therefrom. The cap may be clipped to the caulking gun when caulking is being dispensed from the cartridge via the gun.

6 Claims, 6 Drawing Figures

CAP FOR THE NOZZLE OF A CAULKING CARTRIDGE

BACKGROUND OF THE INVENTION

This invention relates generally to closures for dispensing devices and more particularly to an improved cap for placement on the nozzle of a cartridge containing caulking or other hardenable and extrudable material to prevent discharge of caulking from the nozzle and to seal the caulking within the cartridge from the atmosphere to prevent it from hardening.

Initially, the tip of the dispensing nozzle of a caulking cartridge is sealed or closed from the atmosphere to prevent the caulking in the cartridge from hardening prior to use. When application of the caulking is desired, the sealed tip is simply cut off, leaving an opening through which the caulking may be dispensed. Oftentimes, however, the contents of a caulking cartridge may not be entirely dispensed during a caulking operation, and if precautions are not taken to reseal or close the nozzle, the remaining caulking compound will harden (especially in the nozzle area) due to exposure to the atmosphere. The same problem is also encountered when the nozzle of a cartridge or tube of glue or other hardenable and extrudable substance is opened and partially used.

Various nozzle closures have been used to avoid the above-mentioned problem, and reference may be made to U.S. Pat. No. 3,930,599 and U.S. Pat. No. Re. 18,526 for closures generally in the field of this invention.

SUMMARY OF THE INVENTION

Among the several objects of this invention may be noted the provision of an improved cap for placement on the end of a nozzle of a cartridge containing caulking or other hardenable and extrudable material to prevent further discharge of the caulking from the cartridge after a caulking operation has been completed and to seal the remaining caulking within the cartridge from the atmosphere and prevent hardening thereof; the provision of such a cap which is securely held on the nozzle; the provision of such a cap which is readily placed on and removed from the nozzle; the provision of such a cap which may be detachably mounted on a dispensing tool (oftentimes known as a gun) in which the cartridge may be held for dispensing of the cartridge contents; and the provision of such a cap which is simple in design for economical manufacture.

Generally, a cap of this invention is adapted to be placed on the end of a nozzle, such as the nozzle of a cartridge adapted to be loaded into a dispensing tool for dispensing caulking or hardenable and extrudable material from the cartridge. The cap, which is adapted to seal the nozzle and prevent discharge therefrom, comprises an elongate hollow body closed at one end constituting its front end and open at its back end for placement of the cap on the nozzle with the nozzle inside the body. An elongate plug extends rearwardly within the body from the front end thereof and is adapted to enter the nozzle and plug it on placement of the cap on the nozzle for sealing the latter and preventing discharge from the nozzle. Means are also provided on the body for detachably mounting the cap on the dispensing tool when the extrudable material is being dispensed from the cartridge via the tool. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
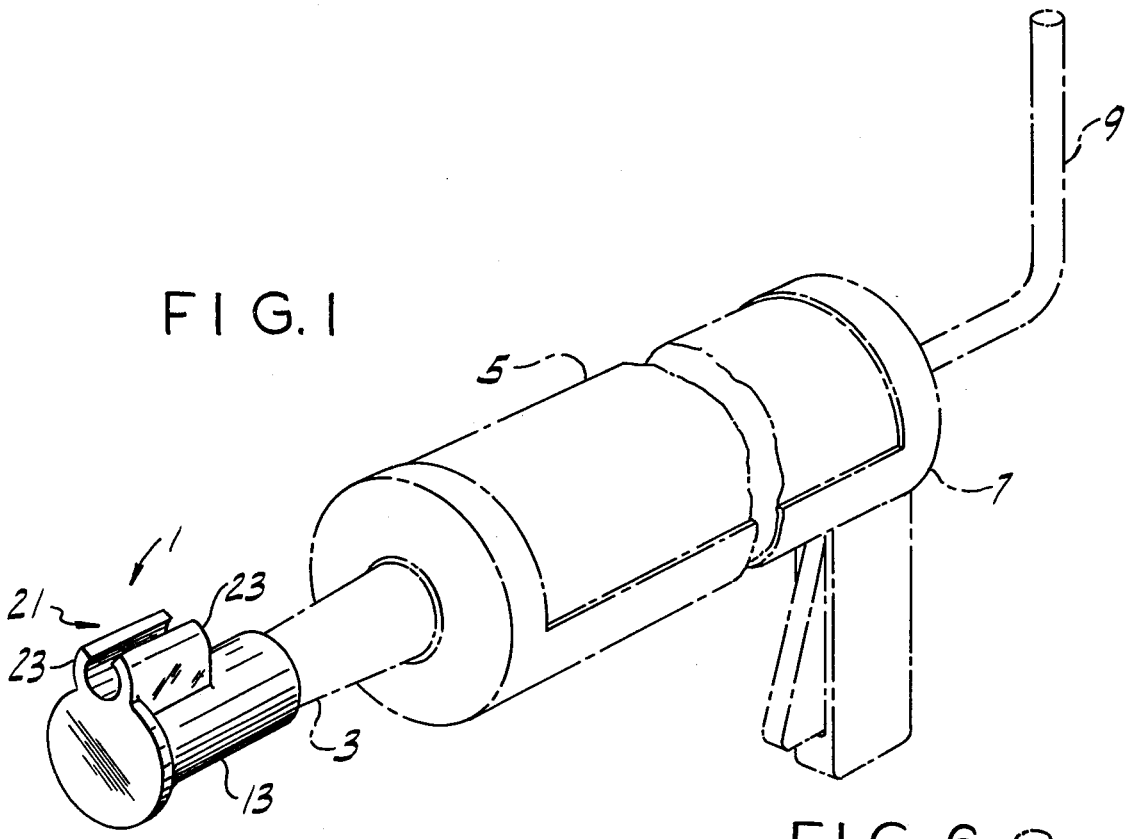
FIG. 1 is a perspective of a cap of this invention mounted on the nozzle of a caulking gun (shown in phantom)

Referring now to the drawings, particularly to FIG. 1, a cap of this invention, designated in its entirety by the reference numeral 1, is shown on the end of a nozzle 3 of a cartridge 5 containing caulking, for example, although it will of course be understood that other extrudable and hardenable substances (e.g., glue or sealant) may also be contained therein. As shown, the cartridge is held in a dispensing tool 7, commonly known as a caulking gun. Indicated at 9 at the back of the caulking gun 7 is a handle in the form of an L-shaped rod. As will be well known to those familiar with caulking guns, this handle has at its forward (left) end a flat circular plate (not shown) axially slideable within the cartridge 5 for forcing the caulking out nozzle 3 for application.

Figure 5:
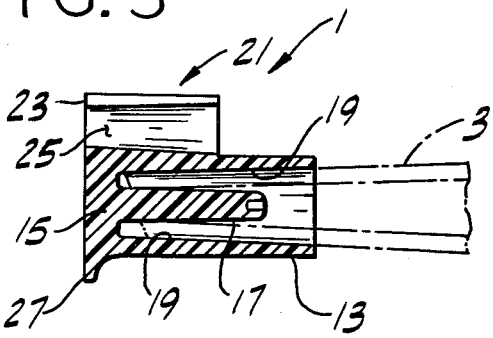
FIG. 5 is a section on line 5—5 of FIG. 3.

The cap, which preferably is a one-piece molded cap of a resilient synthetic resin material such as polyethylene, comprises an elongate hollow body 13, generally circular in cross-section, closed at its front end (left end as viewed in FIG. 5) by an end wall 15 and open at its back (right) end for placement of the cap on nozzle 3 with the latter received inside the body (see FIG. 5). Extending rearwardly (to the right) within body 13 from the front end wall 15 and formed integrally with the wall is an elongate slender plug 17 which is tapered toward its outer end. When the cap is placed on the nozzle of the caulking gun, this plug is adapted to enter into the nozzle and to close or seal it. The fact that the plug is tapered ensures an air-tight fit between the plug and the inside surface of the nozzle at the end of the nozzle, thus preventing exposure of the caulking in the nozzle 3 and cartridge 5 to the atmosphere. It should also be noted that the inside walls 19 of body 13 converge toward the front of the body so that on placement of the cap onto the nozzle, the latter becomes securely wedged between the side walls and the plug. This is advantageous inasmuch as the firm grip between the cap and the nozzle enables the cap to remain securely in place on the nozzle.

Figure 6:
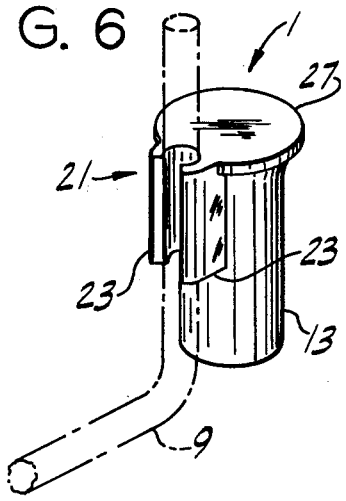
FIG. 6 is a perspective of the cap mounted on the handle of the caulking gun shown in FIG. 1.
Figure 2:
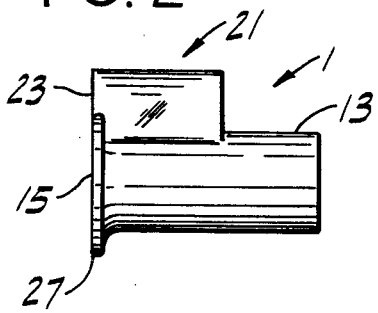
FIG. 2 is a front elevational view of the cap as shown in FIG. 1.
Figure 3:
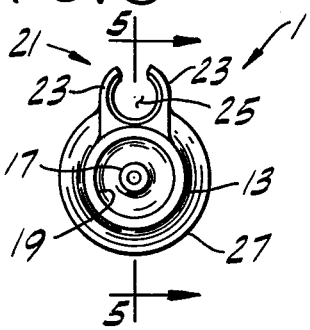
FIG. 3 is a right end elevation of FIG. 2.
Figure 4:
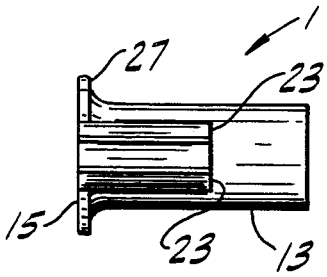
FIG. 4 is a plan of FIG. 2.

In accordance wih this invention, cap 1 further includes a spring clip 21 on the outside of body 13 and molded integrally therewith for mounting the cap on the handle 9 of the caulking gun with the longitudinal axis of the cap generally parallel with the handle. More particularly, this clip 21 comprises a pair of relatively wide arms, each designated 23, extending one alongside the other on the outside of the body and defining an elongate passage 25 therebetween for receiving a relatively substantial length of the handle 9 of the caulking gun 7. As shown in FIG. 6, the cap may be detachably mounted on the handle (as when the gun is being used in a caulking operation) by sliding the cap down onto the handle with the handle received between arms 23 in passage 25. In this connection, the arms 23 being integral with the rest of the cap are resilient so as to flex apart and grip the handle when the cap is placed thereon thereby to securely mount the cap on the handle. The cap may be removed from the handle simply by sliding the cap up off the handle. It shall also be observed that passageway 25 decreases in size from one end to the other, i.e., from right to left as viewed in FIG. 5. This allows the spring clip 21 to accommodate a wider range of handle sizes.

To facilitate the placement of the cap on the handle and its removal therefrom, the end wall 15 at the front of body 3 has an annular flange 27 at its periphery to provide an enlarged gripping surface.

It will be apparent from the foregoing that an improved cap of this invention may be readily placed on and removed from the nozzle of a cartridge containing caulking, for example, and that it is effective in sealing the nozzle both to prevent further discharge of caulking from the cartridge after a caulking operation has been completed and to prevent the remaining caulking within the cartridge from hardening. Moreover, the cap may be readily and securely clipped onto the handle of the caulking gun when it is being used, thus reducing the chances that the cap will be lost or misplaced. In addition, the cap is simple in design for economical production for reduced cost. It will of course be understood that a cap of this invention may also be used to seal open-nozzle containers of other hardenable substances, such as glue or sealant.

In view of the above, it will be seen that the several objects of the invention are achieved and other advantageous results attained.

As various changes could be made in the above construction without departing from the scope of the invention, it is intended that all matter contained in the above description or shown in the accompanying drawings shall be interpreted as illustrative and not in a limiting sense.

What is claimed is:

1. For placement on the end of a nozzle, such as the nozzle of a cartridge adapted to be loaded into a dispensing tool for dispensing caulking or other hardenable and extrudable material from the cartridge, a cap for sealing the nozzle and preventing discharge therefrom, said cap comprising an elongate hollow body closed at one end constituting its front end and open at its back end for placement of the cap on the nozzle with the nozzle received inside said body, an elongate plug formed integrally with the body and extending rearwardly within the body from the front end thereof, said plug being adapted to enter the nozzle and plug it on placement of the cap on the nozzle for sealing the nozzle and preventing said discharge, and a spring clip formed integrally with the body on the outside of the body for detachably mounting the cap on a generally rod-shaped handle of the dispensing tool with the longitudinal axis of the cap generally parallel with the handle when the extrudable material is being dispensed from the cartridge via the tool, said clip comprising a pair of relatively wide arms extending one alongside the other on the outside of the body axially of the body and defining an elongate passage therebetween decreasing in size from one end to the other for receiving said handle, said arms being of resilient material and adapted to flex apart and grip the handle when the handle is received in said passage thereby to mount the cap on the handle.

2. A cap as set forth in claim 1 wherein said body is generally circular in cross section.

3. A cap as set forth in claim 1 wherein the inside walls of said body converge from the open to the closed end of the body whereby on placement of the cap on the nozzle, the nozzle is adapted to become wedged between the inside walls of the body and the plug thereby to secure the cap on the nozzle.

4. A cap as set forth in claim 1 wherein the front end of said body has a peripheral flange around it to assist in placing the cap on said nozzle and removing the cap from the nozzle.

5. A cap as set forth in claim 1 wherein said plug is generally circular in transverse section and tapered toward its outer end.

6. A cap as set forth in claim 1 wherein said cap is a one-piece molded cap of synthetic resin.

* * * * *